US005854627A

United States Patent [19]

Kurihara et al.

[11] Patent Number: 5,854,627

[45] Date of Patent: Dec. 29, 1998

[54] TFT LIQUID CRYSTAL DISPLAY DEVICE HAVING A GRAYSCALE VOLTAGE GENERATION CIRCUIT COMPRISING THE LOWEST POWER CONSUMPTION RESISTIVE STRINGS

[75] Inventors: Hiroshi Kurihara; Shinichi Iwasaki; Yasuyuki Mishima, all of Mobara, Japan

[73] Assignees: Hitachi, Ltd., Tokyo; Hitachi Device Engineering Co., Ltd., Mobara, both of Japan

[21] Appl. No.: 555,412

[22] Filed: Nov. 9, 1995

[30] Foreign Application Priority Data

Nov. 11, 1994 [JP] Japan ..... 6-277351

[51] Int. Cl.[6] ..... G09G 5/00

[52] U.S. Cl. ..... 345/211; 345/89

[58] Field of Search ..... 345/87, 100, 211, 345/212, 94, 98, 99, 89

[56] References Cited

U.S. PATENT DOCUMENTS 5,130,703 7/1992 Fairbanks et al. ..... 345/94
5,495,287 2/1996 Kasai et al. ..... 345/211
5,517,212 5/1996 Inoue ..... 345/211
5,703,617 12/1997 Callahan, Jr. et al. ..... 345/98

OTHER PUBLICATIONS

SID 94 Digest, "Low–Power 6–bit Column Driver for AMLCDs" pp. 351–354 (1994) by B. Conner, et al.

*Primary Examiner*—Chanh Nguyen
*Assistant Examiner*—Xu-Ming Wu
*Attorney, Agent, or Firm*—Antonelli, Terry, Stout & Kraus, LLP

[57] ABSTRACT

The liquid crystal display device includes a resistive string that divides each of voltage ranges between reference voltages to generate multi-level grayscale voltages to be applied to the liquid crystal layer. The resistances between the terminals of the resistive string to which the reference voltages are applied are set to magnitudes almost proportional to voltage differences between the reference voltages. This makes it possible to provide a liquid crystal display device with low power consumption and high picture quality.

11 Claims, 11 Drawing Sheets

1
V8
R88
R87
R86
R85
R84
R83
R82
R81
R78
R21
R17
R16
R15
R14
R13
R12
R11
V63
V62
V61
V60
V59
V58
V57
V56
V55
V54
V08
V07
V06
V05
V04
V03
V02
V01
V00
R8
V7
V1
R1
V0
Power supply terminal
Resistance
Reference voltage
Voltage difference
10mA
5mA
R8 (100)
R7 (100)
R6 (100)
R5 (100)
R4 (100)
R3 (100)
R2 (100)
R1 (100)
(Ω)
6
5
4
3.5
3
2.5
2
1
0
(V)
V8 (7) 1
V7 (6) 1
V6 (5) 0.5
V5 (4) 0.5
V4 (3) 0.5
V3 (2) 0.5
V2 (1) 1
V1 (0) 1
Vn (n−1) / Rn ≠Constant
n=1~8

TFT LIQUID CRYSTAL DISPLAY DEVICE HAVING A GRAYSCALE VOLTAGE GENERATION CIRCUIT COMPRISING THE LOWEST POWER CONSUMPTION RESISTIVE STRINGS

BACKGROUND OF THE INVENTION

1. [Industrial Field of Application]

The present invention relates to a liquid crystal display device used on personal computers and workstations, and more particularly to a grayscale voltage generation circuit for a liquid crystal display device capable of multi-level grayscale display.

2. [Prior Art]

An example of a TFT liquid crystal display device capable of, say, a 64-level-grayscale multi-color display is described in the following literature I:

I: "Low-Power 6-bit Column Driver for AMLCDs" (issued in June, 1994, SID 94 DIJEST p. 351–354).

FIG. 8 is a block diagram showing an outline configuration of the TFT liquid crystal display device introduced in the above literature I.

In FIG. 8, the liquid crystal display panel (TFT-LCD) consists of 800×3×600 pixels PIX.

An equivalent circuit for a pixel on the TFT liquid crystal display panel is shown in FIG. 9.

Denoted ITO is a pixel electrode, and COM an opposite electrode. The liquid crystal display pixel (not shown) is formed of an ITO, a COM and a liquid crystal layer.

The liquid crystal display element is equivalently represented by an electrostatic capacitance CLC.

Because the transmissivity of the liquid crystal display element changes according to a voltage applied between ITO and COM, as shown in FIG. 14, a multi-level grayscale display can be achieved by applying to the pixel electrode ITO a grayscale voltage whose magnitude is determined for each of the grayscale levels with a voltage applied to COM taken as a reference voltage.

Symbol Dn represents a drain line or video signal line, and the grayscale voltage is applied to a plurality of drain lines Dn from a drain driver 11.

Designated TFT is a thin film transistor, which has a source S electrically connected to ITO, a drain D electrically connected to Dn, and a gate G. Electrical conduction and nonconduction between Dn and ITO is controlled by a voltage applied to the gate G.

Denoted Gn is a gate line or scan line and connected to the gates G of the TFTs for particular pixels PIX. It is therefore possible to select pixel electrodes ITO to which one wishes to apply the grayscale voltage by choosing an appropriate gate line Gn.

Symbol Cadd is a holding capacitance and Cn is a capacitor line. The holding capacitance Cadd can hold the grayscale voltage applied to the pixel electrode ITO until the next grayscale voltage is applied to ITO.

FIG. 10 is a timing diagram for voltage waveforms applied to the pixels of FIG. 9.

In the figure, (1) represents the waveform of the gate line Gn, (2) represents the waveforms of the opposite electrode COM and capacitor line Cn, and (3) represents the waveform of the drain line Dn. When a grayscale voltage is applied to the pixel electrode ITO, the gate voltage waveform (1) rises to a gate on level bringing the TFT source and drain into conduction. The drain voltage waveform (3) and the opposite electrode voltage waveform (2) are opposite in phase, and the difference voltage between the drain voltage and the opposite electrode voltage is applied to the liquid crystal display element CLC. Since the gate voltage waveform (1), the opposite electrode voltage waveform (2) and the drain voltage waveform (3) are so set that the voltage for the liquid crystal display element CLC is applied in positive and negative polarity alternately, no DC component is impressed on the liquid crystal display element CLC, eliminating such problems as short life of the TFT liquid crystal display panel, image burn on the panel and residual image.

A feature of the liquid crystal display device using TFTs is that because the grayscale voltages are applied to the pixel electrodes ITO through the TFTs, the switching devices, there is no cross talk between pixels PIX, allowing a multi-level grayscale display without having to use a special drive method for the prevention of cross talk that has been used in the simple matrix liquid crystal display device.

As shown in FIG. 8, the drain driver 11 is installed on one side of the liquid crystal display panel TFT-LCD and connected to the drain lines of the thin film transistors TFT to supply a voltage to the thin film transistors TFT for driving the liquid crystal.

On one side of the liquid crystal display panel TFT-LCD is arranged a gate driver 12 which is connected to the gate lines of the thin film transistors TFT to supply a gate on voltage to the gate G of the thin film transistors TFT for one horizontal operation time 1H.

A display controller 10 receives display data and display control signal from the computer through an interface connector to drive the drain driver 11 and the gate driver 12.

The display data from the computer consists of 18 bits, 6 bits each for red, green and blue.

The drain driver 11, as shown in FIG. 11, has one grayscale voltage generation circuit, which generates grayscale voltages for 64 levels from nine reference voltage values V0–V8 input from an internal power supply circuit 13.

In synchronism with a display data latch clock signal CLK1, the drain driver 11 takes into input registers through a shift register as many sets of 6-bit display data as will be output. Next, in response to an output timing control clock signal CLK2, the display data in the input registers is taken into storage registers, and output voltage drivers selects from 64 grayscale voltages generated by the grayscale voltage generation circuit the grayscale voltages corresponding to the display data and outputs them to the respective drain lines Dn.

A polarity terminal of the drain driver 11 is used to control the polarity of the voltage to be output to the drain line Dn, and carry input and carry output terminals are provided to establish a link between a plurality of drain drivers 11 in the liquid crystal display device.

FIG. 12 shows the grayscale voltage generation circuit of the drain driver 11 of FIG. 11.

As shown in FIG. 12(*a*), the grayscale voltage generation circuit of the drain driver 11 of FIG. 11 divides each of the voltage spans between the nine reference voltage values VO–V8 input from the internal power supply circuit 13 into eight equal parts by a resistive string 1 to produce grayscale voltages for 64 grayscale levels V00–V63.

[Problem Addressed by the Invention]

As shown in FIG. 14, the relation between the voltage applied to the liquid crystal layer and the transmissivity is generally not linear. At regions where the transmissivity is high or low, the change in transmissivity for a given change in the voltage applied to the liquid crystal layer is small, whereas in an intermediate area the change in transmissivity is large.

Hence, in a liquid crystal display device capable of a multi-color display in 64 grayscale levels, to linearly display 64 grayscale levels requires the reference voltage values applied to the grayscale voltage generation circuit of the drain driver 11 to be not equal in intervals and to be such that the voltage intervals are small in an intermediate grayscale range V2–V6 and large in other range V0–V2, V6–V8.

The literature cited above, however, does not give any detail as to how the resistance value of the resistive string 1 in the grayscale voltage generation circuit of the drain driver 11 shown in FIG. 12 is set.

Hence, applying the reference voltages V0–V8 with unequal intervals such as shown in FIG. 14 to the resistive string 1 of the grayscale voltage generation circuit of FIG. 12(*a*) results in a DC current flowing in a line that supplies the reference voltage, giving rise to a problem of an increased power consumption.

FIG. 12(*b*) simplifies what is shown in FIG. 12(*a*). If, in the grayscale voltage generation circuit, the resistance between each reference voltage application terminal of the resistive string 1 is set constant at 100 ohm, the voltage differences between the reference voltages V0 and V1, between V1 and V2, between V6 and V7 and between V7 and V8 are two times those between V2 and V3, between V3 and V4, between V4 and V5 and between V5 and V6.

Therefore, the currents flowing between the terminals of the resistive string 1 to which the reference voltages V6, V7 are applied and between the terminals to which the reference voltages V1, V2 are applied are 10 mA (1.0 V/100 Ω=10 mA), whereas the currents flowing between the terminals to which the reference voltages V5, V6 are applied and between the terminals to which the reference voltages V2 and V3 are applied are 5 mA (0.5 V/100 Ω=5 mA).

Hence, currents flow into or out of the terminals of the resistive string 1 to which the reference voltages V6 and V2 are applied-the terminals where the current value is discontinuous. This increases the current flowing into the grayscale voltage generation circuit, which in turn raises a problem of increased power consumption of the drain driver 11.

When a current flows in or out of the line that supplies the reference voltages V1–V7, another problem arises, i.e., increased power consumption due to internal resistance of the power supply circuit 13.

FIG. 13 shows a circuitry for generating the reference voltages V0–V8 of the power supply circuit 13.

FIG. 13(*a*) represents a case where the circuit to generate the reference voltages V0–V8 is formed of a resistor voltage dividing circuit. The reference voltages V0–V8 are determined by the ratio of resistors RR0–RR9. The outputs of the voltage dividing circuit made up of resistors RR0–RR9 are amplified by buffer circuits OP0–OP9 to sufficient powers before being supplied to the resistive string 1 of the drain driver 11.

FIG. 13(*b*) represents an equivalent circuit for FIG. 13(*a*). The power supply circuit 13 can be expressed as comprising DC voltage sources v0–v8 and internal resistors r0–r8. The DC voltage sources v0–v8 are considered to be determined by the outputs of the voltage dividing circuit of the resistors RR0–RR9, and the internal resistors r0–r8 by output impedances of the buffer circuits OP0–OP9.

Suppose the internal resistors r0–r8 are set to 20 ohm. When a current of 5 mA flows in the supply line for the reference voltage V2, an additional power of 0.5 mW is consumed by the power supply circuit 13. Because the internal resistor r2 causes a voltage drop of 0.2 V, the reference voltage V2 output to the drain driver 11 also falls 0.2 V. As a result, an intended grayscale voltage cannot be output to the liquid crystal display panel, resulting in a failure to produce a correct grayscale display.

Because the output of the grayscale voltage generation circuit is shared by all the drain lines that are driven by a drain driver 11, as shown in FIG. 11, in order to simplify its configuration and reduce the chip size of the IC circuit, as the number of drain signal lines in one drain driver 11 that are used to select the same grayscale voltage increases, the currents flowing in the resistors R1–R8 of the grayscale reference voltage generation circuit 1 increase, with the result that each grayscale voltage varies from one drain driver 11 to another. Particularly on a display screen in a halftone range V2–V6 in which the change in the transmissivity of the liquid crystal layer for the applied voltage is large, a luminance change occurs at a boundary between pixels PIX corresponding to the drain lines Dn and Dn+1 that are driven by different drain drivers 11, deteriorating the display quality.

In the example of FIG. 12, the reference voltage differences V3(2), V4(3), V5(4), V6(5) are smaller than those of V1(0), V2(1), V7(6), V8(7) but the values of R3–R6 are equal to those of R1, R2, R7, R8. This means it is difficult to cause a sufficient amount of current to flow through the output lines of the grayscale voltages V15–V47 output from the resistor voltage dividing circuit between V2 and V6.

SUMMARY OF THE INVENTION

The present invention has been accomplished to solve the above-mentioned conventional drawbacks and its objective is to provide a liquid crystal display device with a grayscale voltage generation circuit that enables a low power consumption and a high picture quality.

These and other objects and novel features of this invention will become apparent from the following description and the accompanying drawings.

[Means to Solve the Problems]

Representative aspects of this invention may be briefly summarized as follows.

(1) The liquid crystal display device generates multi-level grayscale voltages to be applied to the liquid crystal layer, by dividing each of the voltage spans between the adjacent reference voltages by a resistive string. The liquid crystal display device is characterized in that the resistances between the terminals of the resistive string, to which the reference voltages are applied, are made almost proportional to the voltage differences between the reference voltages.

(2) The means (1) mentioned above includes a switching means, which changes the resistances between the terminals of the resistive string, to which the reference voltages are applied, into resistances almost proportional to the voltage differences between the reference voltages.

(3) The means (1) mentioned above has a plurality of series resistors arranged between the terminals of the resistive string to which the reference voltages are applied, and also has a selection means to select from the plurality of the series resistors those series resistors that provide a resistance almost proportional to the voltage differences between the reference voltages.

[Workings]

In the grayscale voltage generation circuit of the liquid crystal display device that generates multi-level grayscale voltages to be applied to the liquid crystal layer, because these means described above ensure that the resistances between the reference voltage application terminals of the resistive string are proportional to the voltage differences between the reference voltages, there is almost no inflow or outflow of current from other than the reference voltage application terminals of the resistive string to which the maximum and minimum reference voltages are applied. This in turn reduces the power consumption of the drain driver 11 and power supply circuit 13 and therefore the overall power consumption of the liquid crystal display device as a whole.

In an intermediate grayscale or halftone region where the change of transmissivity of the liquid crystal layer for an applied voltage change is large, the resistances between the reference voltage application terminals are made small, so that even when the number of drain signal lines that output the same grayscale voltages increases, the variation of the grayscale voltage of the grayscale voltage generation circuit is kept small. This in turn prevents luminance variations from occurring at the boundary between pixels PIX that are driven by different drain drivers 11, thus improving the display characteristic of the liquid crystal display device.

DETAILED DESCRIPTION OF THE PREFERRED EMBODIMENT

Figure 1:
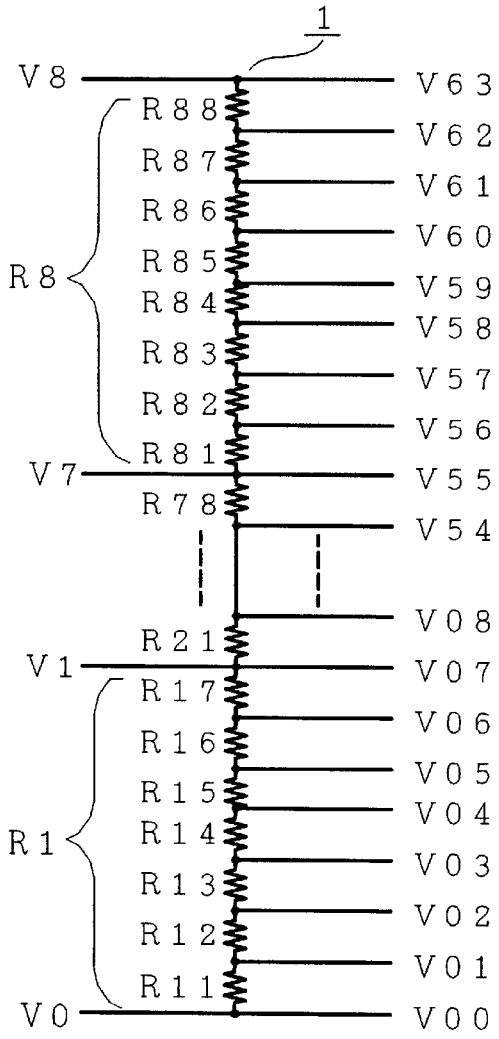
FIG. 1(*a*) and FIG. 1(*b*) are schematic diagrams showing the grayscale voltage generation circuit of the drain driver in the liquid crystal display device as a first embodiment of this invention.
Figure 1:
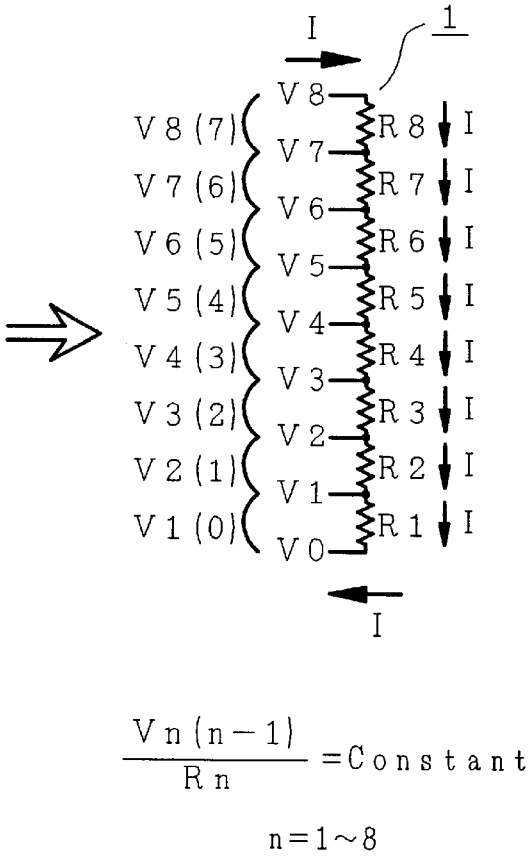

Embodiments of the TFT liquid crystal display devices that apply this invention are described in detail by referring to the accompanying drawings.

In all the drawings used to explain the embodiments, components with identical functions are given like reference numerals and their repetitive explanations are omitted.

Figure 8:
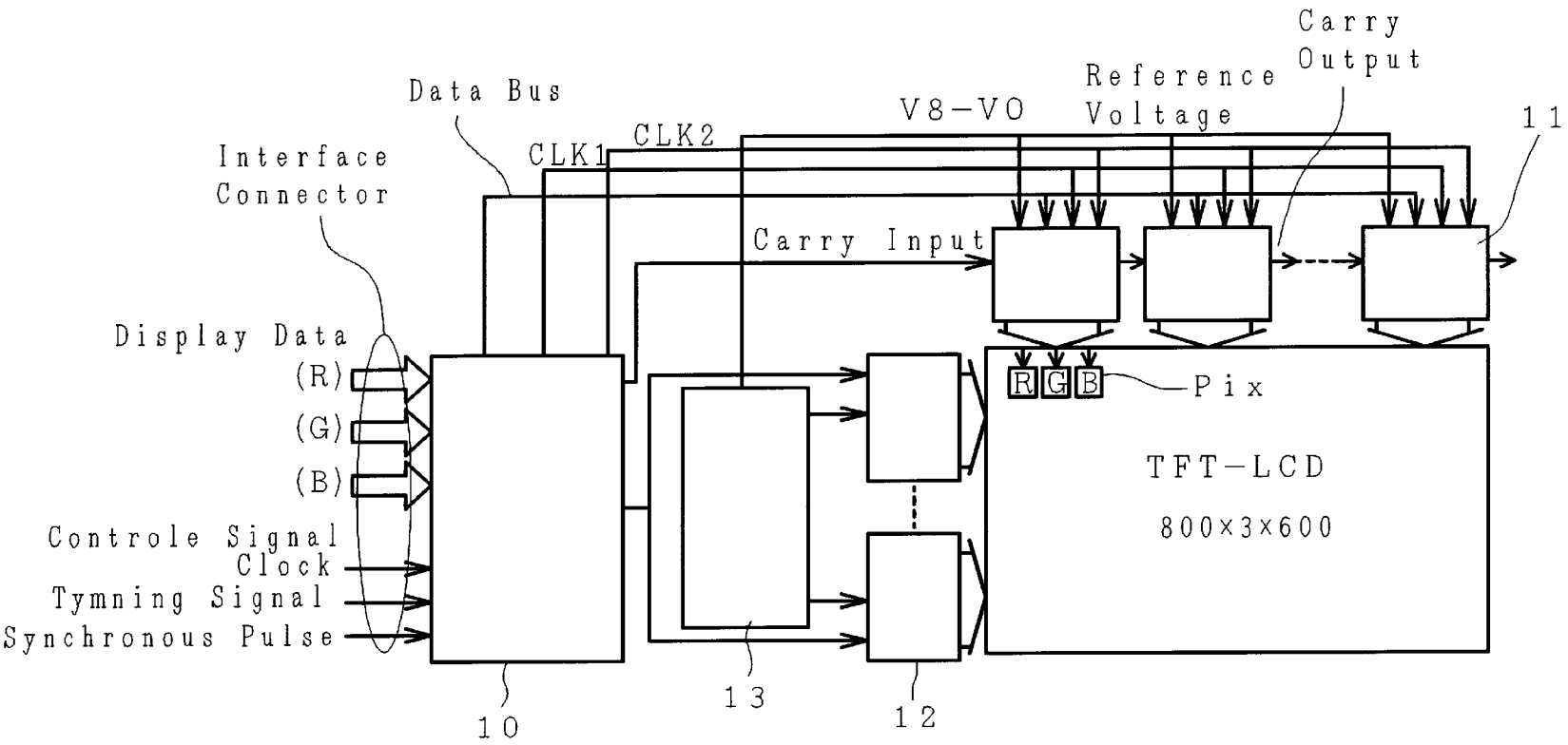
FIG. 8 is a block diagram showing the outline configuration of a TFT liquid crystal display device.

The configuration of the TFT liquid crystal display device applying this invention is identical with that of the TFT liquid crystal display device shown in FIG. 8, and its explanation is omitted.

[Embodiment 1]

FIG. 1 shows a grayscale voltage generation circuit of the drain driver 11 in the liquid crystal display at the first embodiment of this invention.

Figure 12:
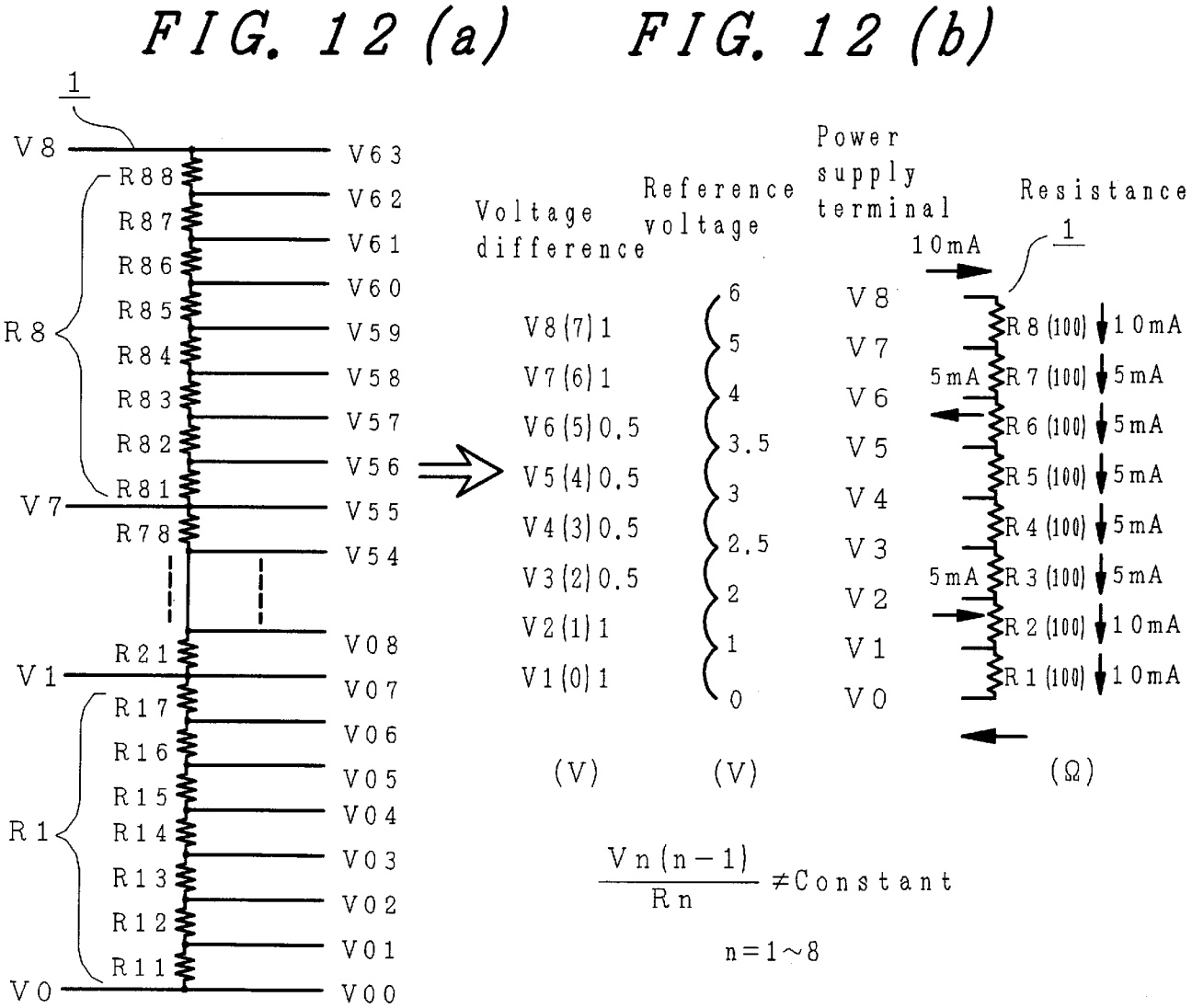
FIG. 12(*a*) and FIG. 12(*b*) are schematic diagrams showing a conventional grayscale voltage generation circuit of the drain driver 11.

The grayscale voltage generation circuit of the Embodiment 1, as with the conventional grayscale voltage generation circuit of FIG. 12, divides each of the voltage spans between nine reference voltage values V0–V8 input from the internal power supply circuit 13 into eight equal parts to produce 64 grayscale voltages in all.

Here, let Vn(n−1) stand for a voltage difference between two adjacent voltages Vn and Vn−1 of the nine reference voltages V0–V8 where n=1 to 8. Also let a synthesized resistance between the terminals for the reference voltages Vn and Vn−1 (n=1 to 8) in the resistive string 1 be Rn.

In the grayscale voltage generation circuit of the Embodiment 1, R8:R7:R6:R5:R4:R3:R2:R1=V8(7):V7(6):V6(5):V5(4):V4(3):V3(2):V2(1):V1(0).

Hence, the current flowing in the resistive string 1 is constant at a certain value (Vn(n−1)/Rn=constant) and the grayscale voltage generation circuit of the Embodiment 1 has almost no inflow or outflow of current from other than the terminals V0 and V8 of the resistive string 1 to which the maximum and minimum reference voltages are applied, thus reducing the power consumption of the drain driver and therefore the power consumption of the liquid crystal display device.

Figure 2:
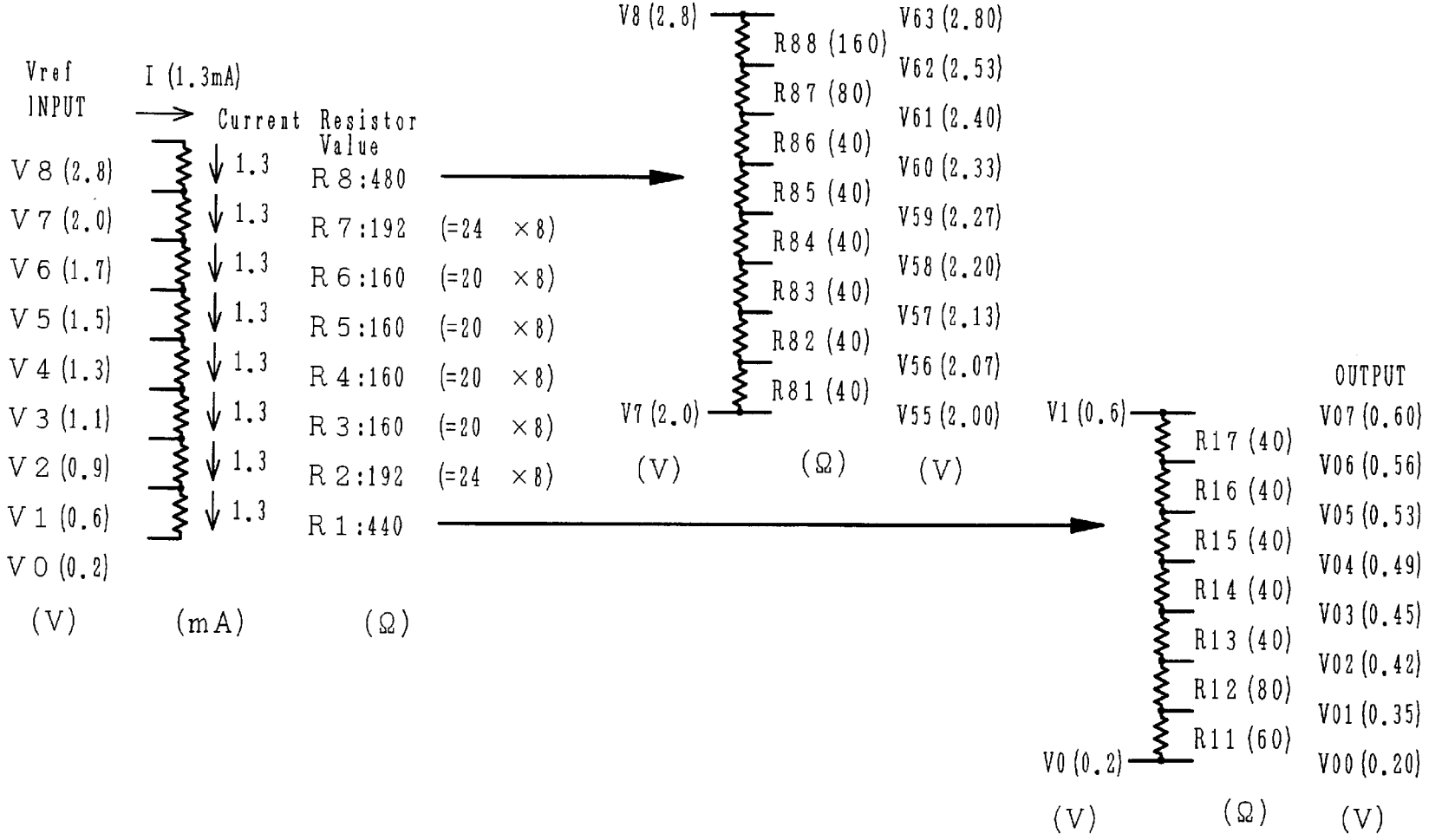
FIG. 2 is a schematic diagram showing example resistances and reference voltages assigned to the grayscale voltage generation circuit of the drain drivers in the liquid crystal display device as the first embodiment of this invention.

FIG. 2 shows the resistive string 1 of FIG. 1 using example resistances to implement the invention.

Figure 3:
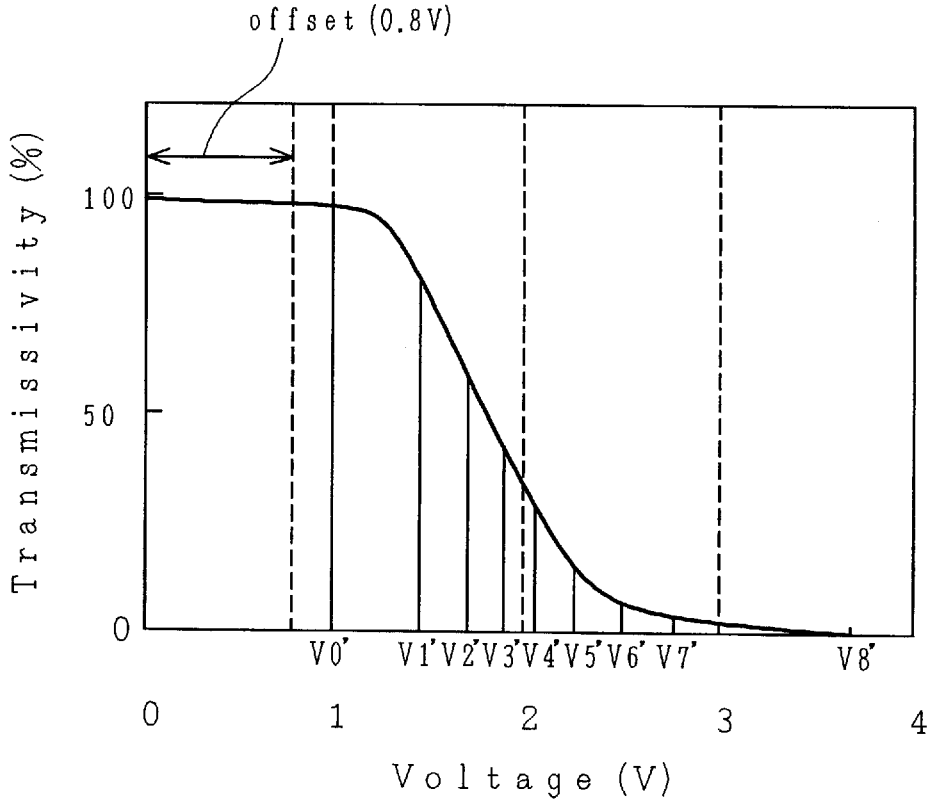
FIG. 3 is a graph showing the relation between the reference voltage shown in FIG. 2 and the transmissivity of the liquid crystal display element.

The resistances shown in FIG. 2 represent a case where the reference voltages V0–V8 are applied to the voltage-transmissivity curve for a liquid crystal whose transmissivity is nearly zero at 3 V as shown in FIG. 3. V0'–V8' shown in FIG. 3 correspond to the reference voltages V0–V8 of FIG. 2.

In the embodiment of FIG. 2, the currents flowing through the resistors R1–R8 between the reference voltage terminals are all 1.3 mA and no current flows through the terminals to which the reference voltages other than V0 and V8 are applied. The power consumed by the resistive string 1 results only from the current of 1.3 mA and is minimum.

In the embodiment of FIG. 2, because the grayscale voltages V62, V63 are set high to make black darker to enhance the contrast, the resistor R8 closest to the terminal of the highest voltage V8 has its component resistors R88 and R87 set higher in resistance than other resistors R81–R86.

Similarly, in the embodiment of FIG. 2, because the grayscale voltages V00, V01 are set low to make white more bright to enhance the contrast, the resistor R1 closest to the terminal of the lowest voltage V0 has its component resistors R11 and R12 set higher in resistance than other resistors R13–R17.

The voltages V0'–V8' in FIG. 3 are shown as the voltage values actually impressed on the liquid crystal layer (not shown) and therefore are shifted by the amount of variation (0.8 V) from the reference voltages V0–V8 of FIG. 2.

Figure 9:
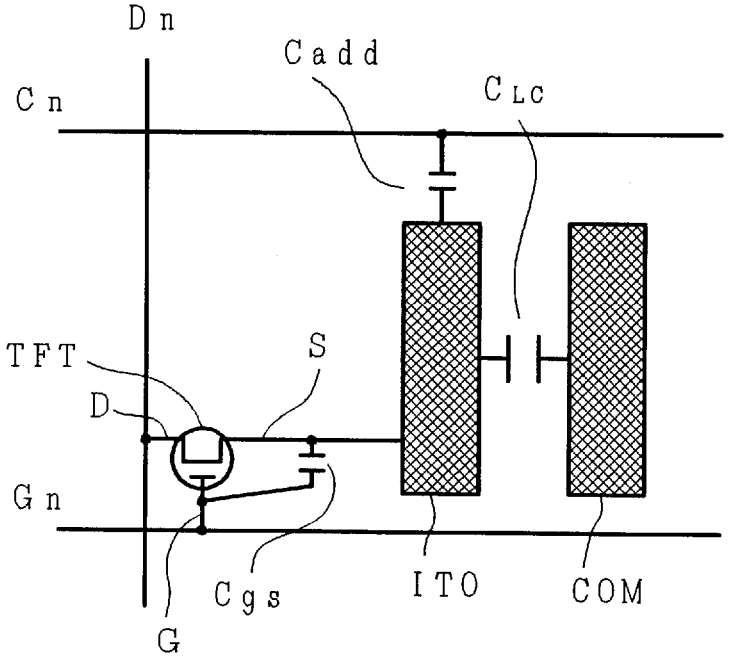
FIG. 9 is a circuit diagram showing an equivalent circuit of a pixel in the TFT liquid crystal display device.
Figure 10:
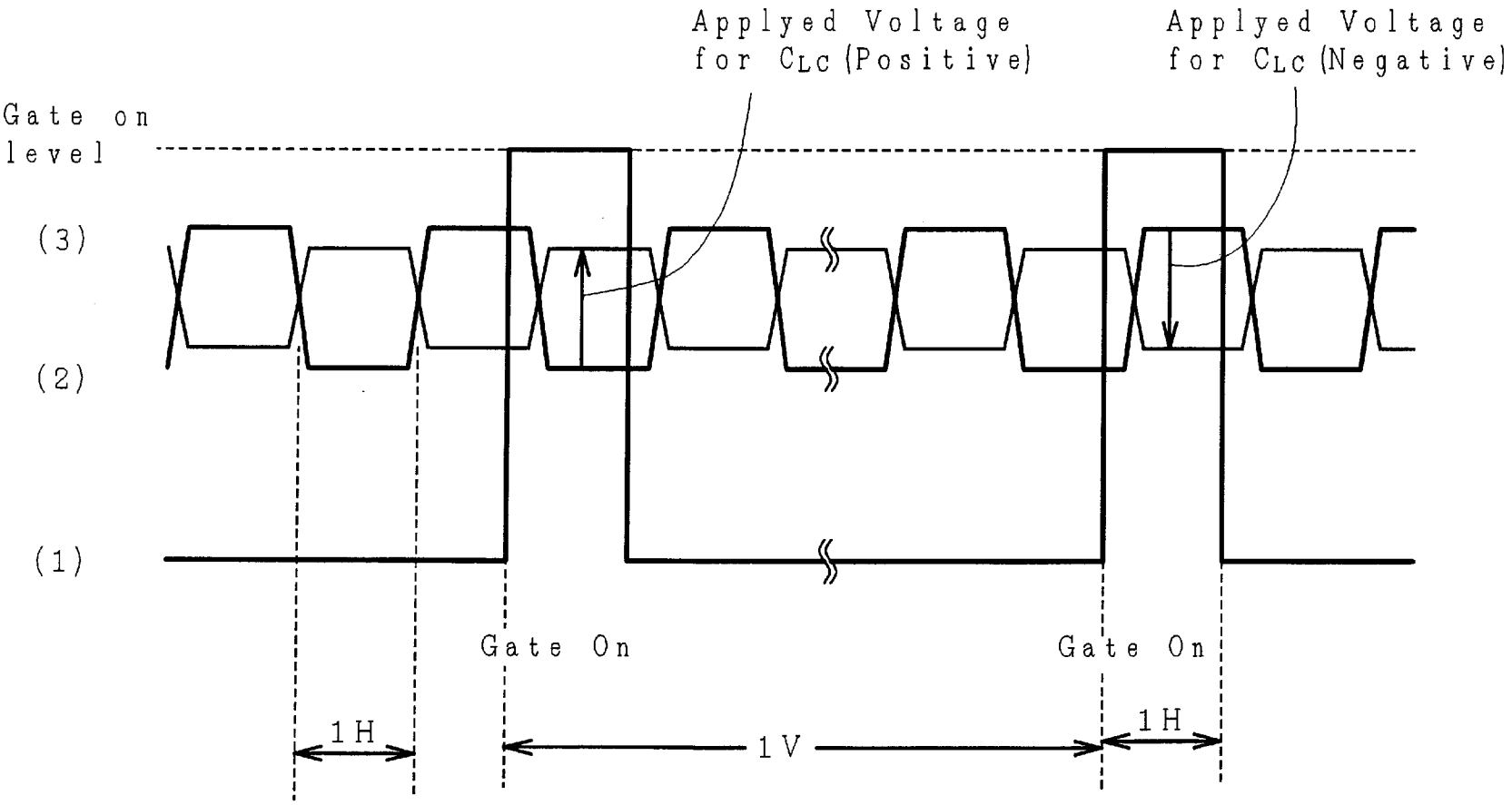
FIG. 10 is a timing diagram showing the timing at which the voltage is applied to the pixel of the TFT liquid crystal display device.
Figure 11:
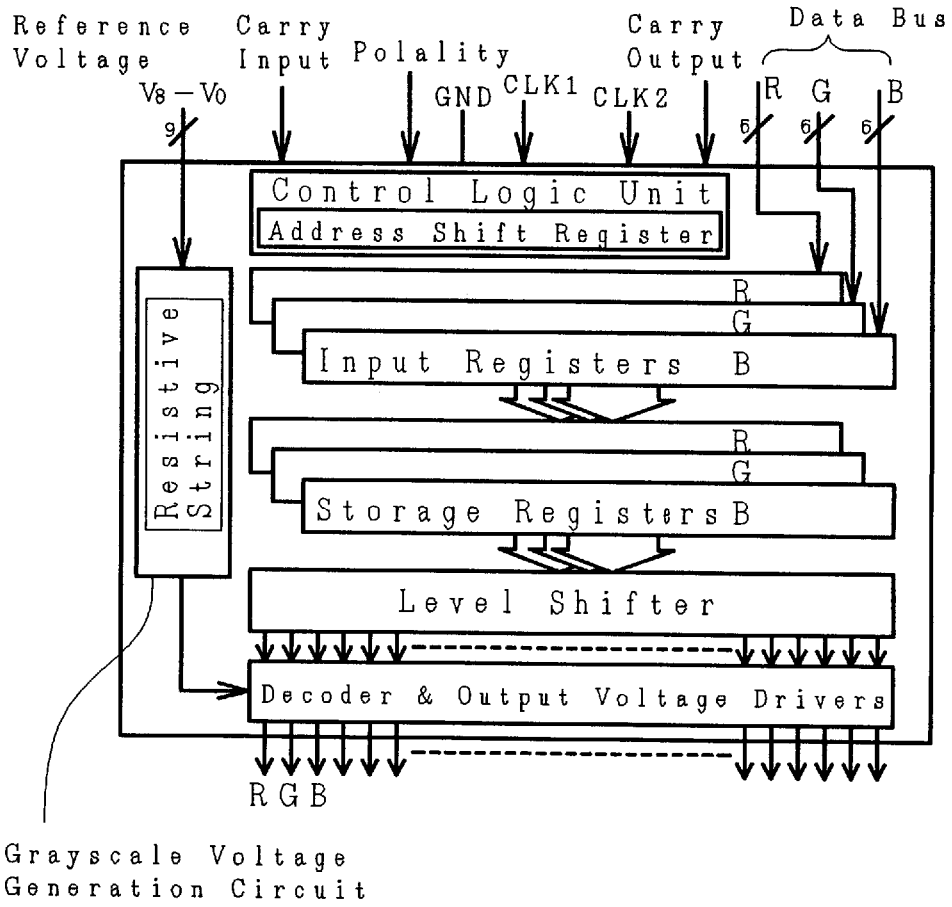
FIG. 11 is a block diagram showing the outline configuration of the drain driver.

The possible cause for the shift, with respect to the reference voltages V0–V8 of FIG. 2, of the voltages actually impressed on the liquid crystal layer may be the gate voltage waveform entering into the pixel electrode ITO. The actual pixel has a stray capacitance cgs between the gate and the pixel electrode ITO, as shown in FIG. 9. When the gate voltage waveform changes from the gate on state to the gate off state according to the driving method of FIG. 10, the resulting pulse is impressed on the pixel electrode ITO through the stray capacitance Cgs, causing the voltage applied to the liquid crystal layer to be shifted.

Hence, when setting the reference voltages V0–V8 of the power supply circuit 13, it is necessary to take into account the shift of the voltage applied to the liquid crystal layer.

The embodiment of FIG. 2 and 3 represents a case where the voltage applied to the liquid crystal is of negative polarity and where the voltage shift is added to the reference voltage. When, however, the voltage to be applied to the liquid crystal has a positive polarity, the reference voltage minus the voltage shift is the one actually applied to the liquid crystal layer, so that two kinds of grayscale reference voltage generation circuit need be provided-positive polarity and negative polarity circuits.

Similarly, the grayscale voltage generation circuit in the drain driver 11, too, has two kinds of resistive string 1, i.e., with positive polarity and negative polarity. One of the resistive strings is selected according to the polarity signal.

In the reference voltage generation circuit of the Embodiment 1, the resistances between the reference voltage application terminals of the resistive string 1 are set completely proportional to the differences between the reference voltages. It is, however, noted that the similar effects can be produced if they are not perfectly proportional.

That is, even if the values of Vn(n−1)/Rn do not completely agree, power consumption can be reduced as long as variations of the value are within a specified range.

The resistive string 1 is formed inside the semiconductor integrated circuit. Resistors made inside the semiconductor integrated circuit generally have variations in resistance, which can be as large as ±20% when a semiconductor diffusion resistor is used. Although it is possible to limit the resistance variation to ±10% by selecting only good semiconductor integrated circuits from bad ones, this reduces the yield of the semiconductor integrated circuits and increases the cost of the drain driver 11. Hence, in the liquid crystal display device using the resistive string 1 of FIG. 1, making the values of Vn(n−1)/Rn completely agree is not practicable though ideal.

In the embodiment of FIG. 2, considering the fact that the resistor R3, which most affects the grayscale display, varies ±20%, the value of Vn(n−1)/Rn—the current flowing through R3—varies by ±0.3 mA (±23%). Because R4 has the same resistance as R3, the current flowing through R4 also varies by ±0.3 mA. When the difference between the currents flowing through R3 and R4 is largest, a current of ±0.6 mA flows through the terminal V3, increasing the power consumption of the resistive string 1 and the power supply circuit 13.

Even when there is a resistance variation of as large as ±20% in the resistive string 1, the application of this embodiment can limit the current flowing through the resistors V1–V7 to less than ±0.6 mA, making it possible to reduce the power consumption of the drain driver 11 and the power supply circuit 13. This in turn keeps the cost of the drain driver 11 practicably low.

If the resistance variation in the resistive string 1 of the embodiment shown in FIG. 2 is kept within ±10%, the current flowing through the resistors R3 and R4 can be limited to the variation of ±0.2 mA (±15%). Hence, when the difference between the currents flowing through the resistors R3 and R4 is largest, a current of ±0.4 mA flows in the terminal V3, further reducing an increase in power consumption of the resistive string 1 and power supply circuit 13. This is very desirable.

Figure 13:
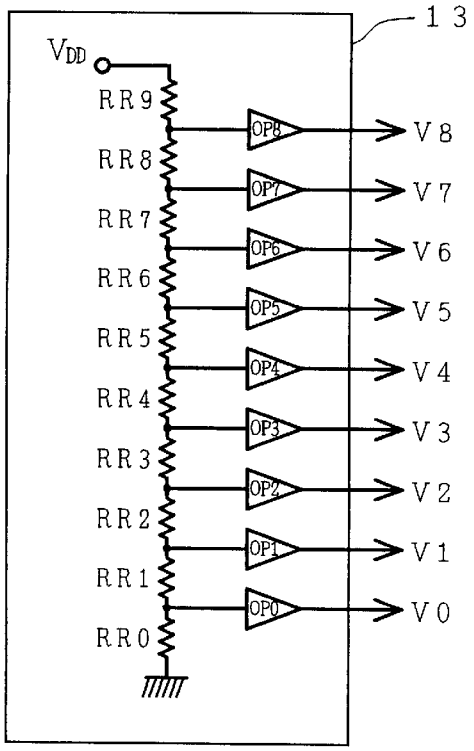
FIG. 13(*a*) FIG. 13(*b*) are schematic diagrams showing the reference voltage generation circuit in the power supply circuit.
Figure 13:
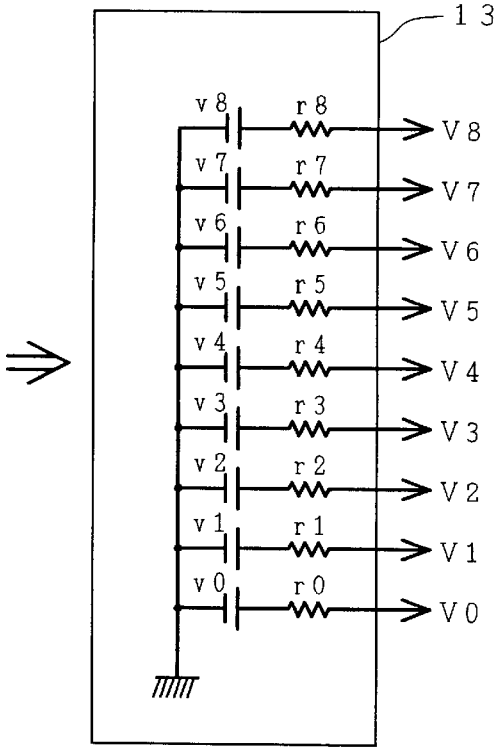

Because this embodiment can limit the current flowing in the output terminals V1–V7 of the power supply circuit, when the power supply circuit 13 of the configuration shown in FIG. 13 is used, the buffers OP1–OP7 that output the voltages V1–V7 are allowed to have higher output impedances than those of other buffers OP0, OP8 that output the voltages V0, V8. This permits the use of inexpensive buffers, lowering the cost of the power supply circuit 13.

Further, with this embodiment, it is possible to produce the outputs of V1–V7 directly from the resistor voltage dividing circuit by removing the buffers OP1–OP7, further reducing the cost of the power supply circuit 13.

In this embodiment, because the reference voltage differences V4(3), V5(4) assigned to display halftones are small, as shown in FIG. 1, the resistances R5, R4 between the reference voltage application terminals of the resistive string 1 are also small.

That is, in the example of FIG. 2, the reference voltage differences V3(2), V4(3), V5(4) and V6(5) are smaller than V1(0), V2(1), V7(6) and V8(7), but the resistances R3–R6 are sufficiently lower than R1, R2, R7 and R8, so that sufficiently large currents can be made to flow through the output lines of the grayscale voltages V15–V47 produced by the resistor voltage dividing circuits between V2–V6.

As a result, even when the number of drain lines Dn that output the same grayscale voltages increases, the variation of the grayscale voltages output by the grayscale voltage generation circuit is kept small, preventing the occurrence of luminance variations between pixels that are driven by different drain drivers 11.

Hence, by using the grayscale voltage generation circuit of the Embodiment 1, it is possible to achieve the liquid crystal display device with high picture quality and low power consumption.

[Embodiment 2]

Figure 4:
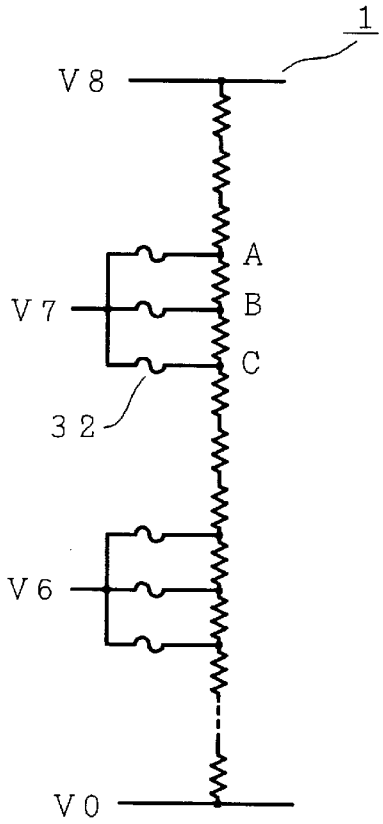
FIG. 4 is a schematic diagram showing a grayscale voltage generation circuit of the drain driver of the liquid crystal display device as a second embodiment of this invention.
Figure 5:
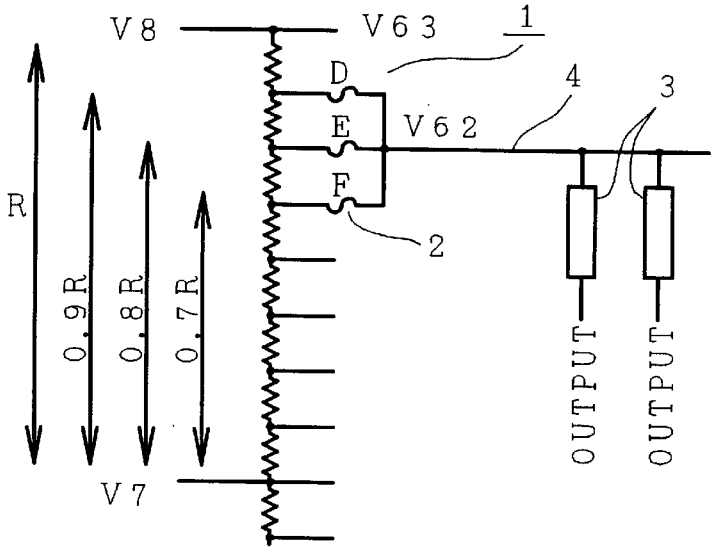
FIG. 5 is a schematic diagram showing a grayscale voltage generation circuit of the drain driver of the liquid crystal display device as a second embodiment of this invention.

FIG. 4 and 5 show a grayscale voltage generation circuit for the drain driver of the liquid crystal display device as a second embodiment of this invention.

Figure 14:
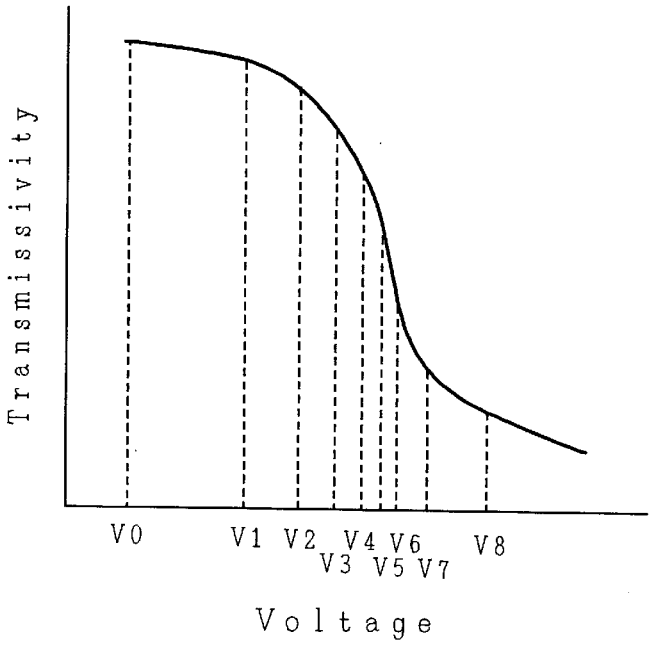
FIG. 14 is a graph showing the relation between the reference voltage of FIG. 11 and the transmissivity of the liquid crystal display element.

The voltage-transmissivity characteristic shown in FIG. 14 generally varies depending on the material of the liquid crystal layer.

Hence, because the reference voltages of the power supply circuit 13 must be set in accordance with the voltage-transmissivity characteristic of the liquid crystal layer and because the grayscale voltage generation circuit in the drain driver 11 must be set according to the voltage-transmissivity characteristic, the drain driver 11 lacks versatility making it necessary to use dedicated drain drivers 11 for each liquid crystal display panel. This in turn increases the cost of the liquid crystal display device.

The Embodiment 2 is a detailed example of the Embodiment 1 and makes variable the setting of the grayscale voltage of the grayscale voltage generation circuit in the drain driver 11 according to the liquid crystal display panel.

In the grayscale reference voltage generation circuit of the Embodiment 2, the reference voltage application terminals for the reference voltages V1–V7 are each connected to several points A, B, C in the resistive string 1 through fuses 32 during the semiconductor device manufacturing stage as shown in FIG. 4.

These points A, B, C are so selected that they produce the voltage dividing values that are likely to be used in practice.

During the actual use, when a specified reference voltage V0–V8 is applied to the grayscale reference voltage generation circuit of the Embodiment 2, no current flows through a fuse 32 connected to the resistor whose resistance is proportional to the voltage difference between the reference voltages, leaving the fuse 32 intact.

Current flows through the other fuses 32, which are blown, with the result that the resistance between the reference voltage application terminals of the resistive string 1 is made proportional to the difference between the reference voltages.

As shown in FIG. 5, also on the side of the resistive string 1 that is connected with an output switch 3, the grayscale voltage output terminal 4 is connected to several points D, E, F in the resistive string 1 through fuses 2.

After a specified grayscale level, say, V62, is selected according to the display data, predetermined voltages are applied to the reference voltage application terminals for V8 and V7 and to the grayscale voltage output terminal 4.

At this time, the grayscale voltage output terminal 4 is subjected to a voltage (0.8×V8(7)) which corresponds to the resistance of a point, for example E, connected with a fuse 2 that one does not want blown.

In the grayscale voltage generation circuit of the second embodiment, when blowing the fuse 2 on the side connected with the output switch 3, only the voltage difference between the reference voltages is set to a value that corresponds to the value actually used during operation and whose absolute value is greater than that used during operation.

In this way, the grayscale voltage generation circuit of the Embodiment 2 can supply a current that will not blow the fuse 2 during operation.

As described above, the Embodiment 2 can provide the drain driver 11 with versatility and easily realize a liquid crystal display device with high picture quality and low power consumption according to the characteristics of various liquid crystal, display panels, as in the Embodiment 1.

[Embodiment 3]

Figure 6:
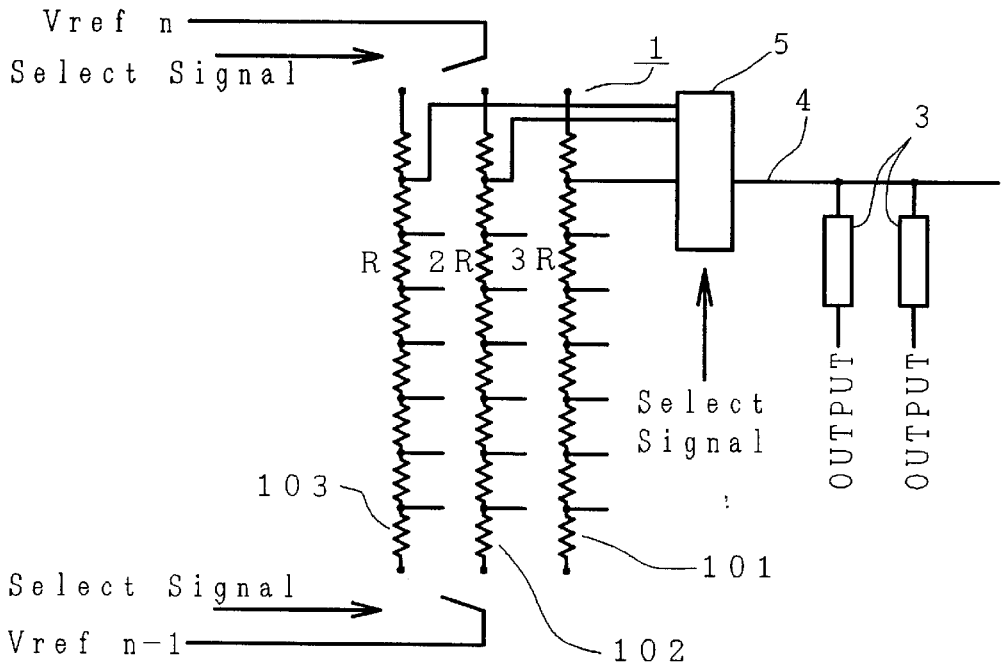
FIG. 6 is a schematic diagram showing a grayscale voltage generation circuit of the drain driver of the liquid crystal display device as a third embodiment of this invention.

FIG. 6 shows a grayscale voltage generation circuit for the drain driver in the liquid crystal display device as a third embodiment of this invention.

The Embodiment 3 is a detailed example of the first embodiment and makes easily variable the setting of the grayscale voltages in the grayscale voltage generation circuit of the drain driver 11 according to the liquid crystal display panel.

The grayscale voltage generation circuit of the Embodiment 3 has several series resistor circuits 101, 102, 103 between each of the reference voltage application terminals V0–V8 of the resistive string 1. During the actual operation, one of the series resistor circuit 101, 102, 103 that provides a resistance ratio close to the ratio of voltage differences between the grayscale reference voltages is selected according to the selection signal during the operation.

A selector switch 5 is switched according to the selection signal to cause the grayscale voltage from one of the series resistor circuits 101, 102, 103 to be output to the grayscale voltage output terminal 4.

The selection signal is sent to the respective drain drivers 11 from the register or EPROM in the display controller 10 or from dedicated input terminals for the interface connector that connects to the computer.

With the above configuration, it is possible to easily realize a resistive string that has a resistance ratio close to the ratio of voltage differences between the adjacent reference voltages used during actual operation. Furthermore, the grayscale voltage generation circuit of the Embodiment 3 can provide the drain driver 11 with versatility and, as in the case of the Embodiment 1, realize a liquid crystal display device with high image quality and low power consumption according to the characteristics of the liquid crystal display panel.

[Embodiment 4]

Figure 7:
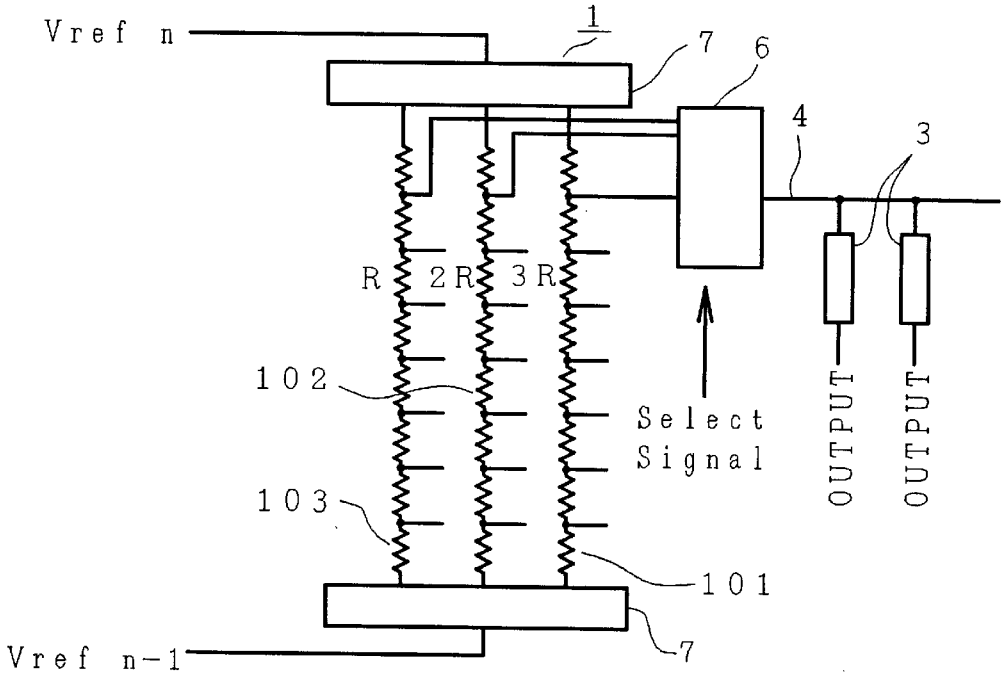
FIG. 7 is a schematic diagram showing a grayscale voltage generation circuit of the drain driver of the liquid crystal display device as a fourth embodiment of this invention.

FIG. 7 shows a grayscale voltage generation circuit for the drain driver in the liquid crystal display device as a fourth embodiment of this invention.

The Embodiment 4 is still another detailed example of the first embodiment and makes easily variable the setting of the grayscale voltages in the grayscale voltage generation circuit of the drain driver 11 according to the liquid crystal display panel.

The grayscale voltage generation circuit of the Embodiment 4, too, has several series resistor circuits 101, 102, 103 between each of the reference voltage application terminals V0–V8 of the resistive string 1, as in the case of the Embodiment 3. One of the series resistor circuit 101, 102, 103 that provides a resistance ratio close to the ratio of voltage differences between the adjacent reference voltages is selected by changing only a metal wiring layer during the process of semiconductor device manufacture.

Similarly, a selection means 6 is switched by changing only the metal wiring layer during the semiconductor device manufacturing process to output the grayscale voltage from one of the series resistor circuits 101, 102, 103 to the grayscale voltage output terminal 4.

With the above configuration, it is possible to easily realize a resistive string that has a resistance ratio close to the ratio of voltage differences between the adjacent reference voltages used during actual operation. Further, the grayscale voltage generation circuit of the Embodiment 4 can provide the drain driver 11 with versatility and, as in the case of the Embodiment 1, realize a liquid crystal display device with high image quality and low power consumption according to the characteristics of the liquid crystal display panel.

While the preceding embodiments concern cases where the invention is applied to the liquid crystal display device, the invention is not limited to this application but can be applied to a wide range of liquid crystal display devices including liquid crystal display modules.

The invention has been described in conjunction with example embodiments and it is noted that the invention is not limited to these embodiments and that many modifications may be made without departing from the spirit of the invention.

Representative advantages of this invention may be briefly summarized as follows.

(1) In a grayscale voltage generation circuit of the liquid crystal display device that generates multi-level grayscale voltages to be applied to the liquid crystal layer, the invention is characterized in that the resistances between each reference voltage application terminals of the resistive string 1 are proportional to the voltage differences between the adjacent reference voltages so that there is almost no inflow or outflow of current to or from other than the reference voltage application terminals to which the maximum and minimum reference voltages are applied. This allows reduction in the power consumption of the drain driver, which in turn reduces power consumption of the liquid crystal display device.

(2) According to this invention, in a halftone display region where the change of transmissivity of the liquid crystal layer with respect to the applied voltage is large, because the resistances between adjacent reference voltage application terminals are small, even when the number of drain signal lines that output the same grayscale voltages increases, the variation of the grayscale voltages in the reference voltage generation circuit is kept small, suppressing the occurrence of luminance variations on the display screen among different drain drivers 11.

What is claimed is:

1. A liquid crystal display device comprising:

a liquid crystal display panel on which a plurality of pixels are arranged, each pixel having a thin film transistor and a pixel electrode electrically connected to a source of said thin film transistor;

a drain driver for outputting to a drain of said thin film transistor a voltage selected from a plurality of grayscale voltages;

a power supply circuit for supplying a plurality of reference voltages to said drain driver; and a gate driver for outputting to a gate of said thin film transistor a voltage that selects said pixel;

wherein said drain driver has a grayscale voltage generation circuit, which divides each of voltage ranges between said reference voltages into a plurality of voltages by a voltage dividing circuit to generate said plurality of grayscale voltages, said voltage dividing circuit comprising resistors connected in series;

wherein resistances between said reference voltages of said voltage driving circuit are set to magnitudes substantially proportional to voltage differences between said reference voltages, at least one of a total resistance of said series connected resistors between one pair of adjacent reference voltages being different from a total resistance of said series connected resistors between another pair of adjacent reference voltages.

2. A liquid crystal display device according to claim 1, further comprising a switching means to change the resistances between said reference voltages of said voltage dividing circuit into said resistances substantially proportional to voltage differences between said reference voltages.

3. A liquid crystal display device according to claim 1, wherein a plurality of series resistor circuits are provided between reference voltages of said voltage dividing circuit, and a selection means is provided to select from among said plurality of series resistor circuits that provides a resistance substantially proportional to the voltage difference between said reference voltages.

4. A liquid crystal display device according to claim 1, further comprising:

a drain line for carrying said voltage selected from a plurality of grayscale voltages from said drain driver to the drain of said thin film transistor; and a gate line for carrying said voltage that selects said pixel from said gate driver to the gate of said thin film transistor, wherein said gate line and said drain line are on a common substrate.

5. A liquid crystal display device according to claim 1, wherein a plurality of linear and non-linear reference voltages are supplied to said drain driver.

6. A liquid crystal display device comprising:

a liquid crystal display panel on which a plurality of pixels are arranged, each pixel having a thin film transistor and a pixel electrode electrically connected to a source of said thin film transistor;

a drain driver for outputting to a drain of said thin film transistor a voltage selected from a plurality of grayscale voltages;

a power supply circuit for supplying a plurality of reference voltages to said drain driver; and a gate driver for outputting to a gate of said thin film transistor a voltage that selects said pixel;

wherein said drain driver has a grayscale voltage generation circuit, which divides each of voltage ranges between said reference voltages into a plurality of voltages by a voltage dividing circuit to generate said plurality of grayscale voltages, said voltage dividing circuit comprising resistors connected in series;

wherein the resistances of said voltage dividing circuit are so set that the values of $Vn(n-1)/Rn$ agree within a specified variation range for all Rn's, where $Vn(n-1)$ represents a voltage difference between one of the reference voltages Vn and an adjacent reference voltage $Vn-1$ and Rn represents a synthesized resistance between voltage application terminals of said voltage driving circuit to which said reference voltages Vn and $Vn-1$ are applied, and at least one synthesized resistance Rn is different from another synthesized resistance Rn.

7. A liquid crystal display device according to claim 6, wherein the magnitude of each resistance of said voltage dividing circuit is set so that the values of $Vn(n-1)/Rn$ agree within a variation range of ±23% for all Rn's.

8. A liquid crystal display device according to claim 6, wherein the magnitude of each resistance of said voltage dividing circuit is set so that the values of $Vn(n-1)/Rn$ agree within a variation range of ±15% for all Rn's.

9. A liquid crystal display device according to claim 6, wherein the magnitude of each resistance of said voltage dividing circuit is set so that the values of $Vn(n-1)/Rn$ agree perfectly for all Rn's.

10. A liquid crystal display device according to claim 6, further comprising:

a drain line for carrying said voltage selected from a plurality of grayscale voltages from said drain driver to the drain of said thin film transistor; and a gate line for carrying said voltage that selects said pixel from said gate driver to the gate of said thin film transistor, wherein said gate line and said drain line are on a common substrate.

11. A liquid crystal display device according to claim 6, wherein a plurality of linear and non-linear reference voltages are supplied to said drain driver.

* * * * *

UNITED STATES PATENT AND TRADEMARK OFFICE

CERTIFICATE OF CORRECTION

PATENT NO : 5,854,627

DATED : December 29, 1998

INVENTOR(S) : Hiroshi KURIHARA et al.

It is certified that error appears in the above-identified patent and that said Letters Patent is hereby corrected as shown below:

Col. 11, line 46
replace "driving"
with --dividing--.

Signed and Sealed this

Twenty-eighth Day of September, 1999

*Attest:*

Q. TODD DICKINSON

*Attesting Officer*

*Acting Commissioner of Patents and Trademarks*